US012723340B2

(12) United States Patent
Yu et al.

(10) Patent No.: US 12,723,340 B2
(45) Date of Patent: Sep. 1, 2026

(54) METHOD FOR CONTROLLING CLOTHING TREATMENT APPARATUS

(71) Applicant: LG ELECTRONICS INC., Seoul (KR)

(72) Inventors: Seonhwa Yu, Seoul (KR); Jaehyun Kim, Seoul (KR); Hyunseok Seo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 295 days.

(21) Appl. No.: 18/717,487

(22) PCT Filed: Nov. 18, 2022

(86) PCT No.: PCT/KR2022/018293
§ 371 (c)(1),
(2) Date: Dec. 18, 2024

(87) PCT Pub. No.: WO2023/106685
PCT Pub. Date: Jun. 15, 2023

(65) Prior Publication Data

US 2025/0270750 A1 Aug. 28, 2025

(30) Foreign Application Priority Data

Dec. 8, 2021 (KR) ..... 10-2021-0174723

(51) Int. Cl.
*D06F 23/02* (2006.01)
*D06F 33/34* (2020.01)
(Continued)

(52) U.S. Cl.
CPC ..... *D06F 34/18* (2020.02); *D06F 23/02* (2013.01); *D06F 33/34* (2020.02); *D06F 33/36* (2020.02);
(Continued)

(58) Field of Classification Search
None
See application file for complete search history.

(56) References Cited

U.S. PATENT DOCUMENTS

2015/0354122 A1 12/2015 Kwon et al.

FOREIGN PATENT DOCUMENTS

JP 2011-239799 A 12/2011
JP 2013-180161 A 9/2013
(Continued)

*Primary Examiner* — Levon J Shahinian
(74) *Attorney, Agent, or Firm* — Birch, Stewart, Kolasch & Birch, LLP

(57) ABSTRACT

The present application relates to a method for controlling a clothing treatment apparatus, comprising: a first detection step of rotating a drum so as to detect an amount of clothing; a water supply step of supplying water to a tub up to a preset clothing-weight-specific reference water level; a foreign substance removal step of rotating the drum so that the clothing is rubbed together in the water; a drainage step of discharging the water stored in the tub; a second detection step of detecting the amount of clothing stored in the drum after the drainage step; a spin-dry step of rotating the drum so as to remove water from the clothing; a third detection step of detecting the amount of clothing stored in the drum after the spin-dry step; a first determination step of determining the material of the clothing according to thickness through the difference between the clothing weight measured in the second detection step and the clothing weight measured in the first detection step; and a second determination step of determining the material of the clothing according to water content through the difference between the clothing weight measured in the third detection step and the clothing weight measured in the first detection step.

13 Claims, 4 Drawing Sheets

(51) Int. Cl.

| | |
|---|---|
| ***D06F 33/36*** | (2020.01) |
| ***D06F 33/40*** | (2020.01) |
| ***D06F 33/42*** | (2020.01) |
| ***D06F 34/18*** | (2020.01) |
| ***D06F 34/20*** | (2020.01) |
| ***D06F 39/08*** | (2006.01) |
| *D06F 103/04* | (2020.01) |
| *D06F 103/06* | (2020.01) |
| *D06F 103/08* | (2020.01) |
| *D06F 103/16* | (2020.01) |
| *D06F 103/24* | (2020.01) |
| *D06F 105/02* | (2020.01) |
| *D06F 105/08* | (2020.01) |
| *D06F 105/10* | (2020.01) |
| *D06F 105/46* | (2020.01) |
| *D06F 105/48* | (2020.01) |

(52) U.S. Cl.

CPC ..... *D06F 33/40* (2020.02); *D06F 33/42* (2020.02); *D06F 34/20* (2020.02); *D06F 39/08* (2013.01); *D06F 2103/04* (2020.02); *D06F 2103/06* (2020.02); *D06F 2103/08* (2020.02); *D06F 2103/16* (2020.02); *D06F 2103/24* (2020.02); *D06F 2105/02* (2020.02); *D06F 2105/08* (2020.02); *D06F 2105/10* (2020.02); *D06F 2105/46* (2020.02); *D06F 2105/48* (2020.02)

(56) References Cited

FOREIGN PATENT DOCUMENTS

| | | | |
|---|---|---|---|
| JP | 2016-158745 | A | 9/2016 |
| KR | 10-2000-0025011 | A | 5/2000 |
| KR | 2001-0105608 | A | 11/2001 |
| KR | 10-2020-0095997 | A | 8/2020 |
| KR | 10-2021-0131075 | A | 11/2021 |

【FIG. 1】
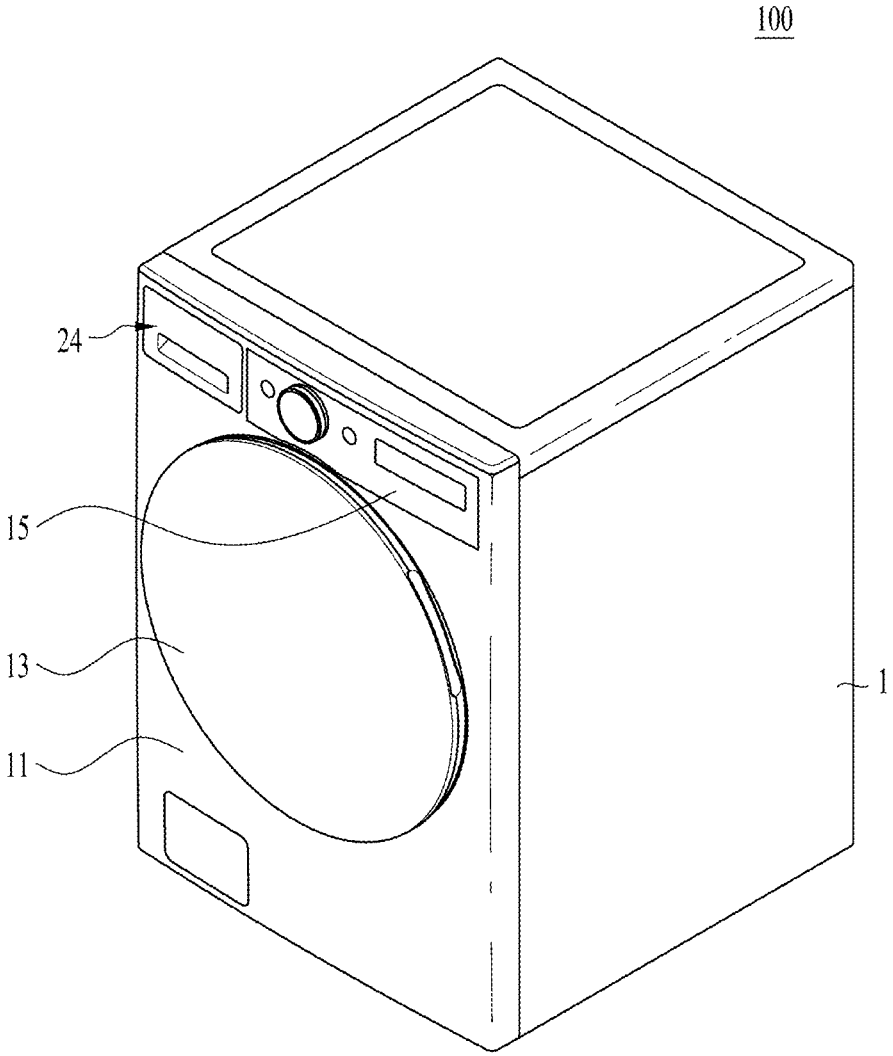

【FIG. 2】
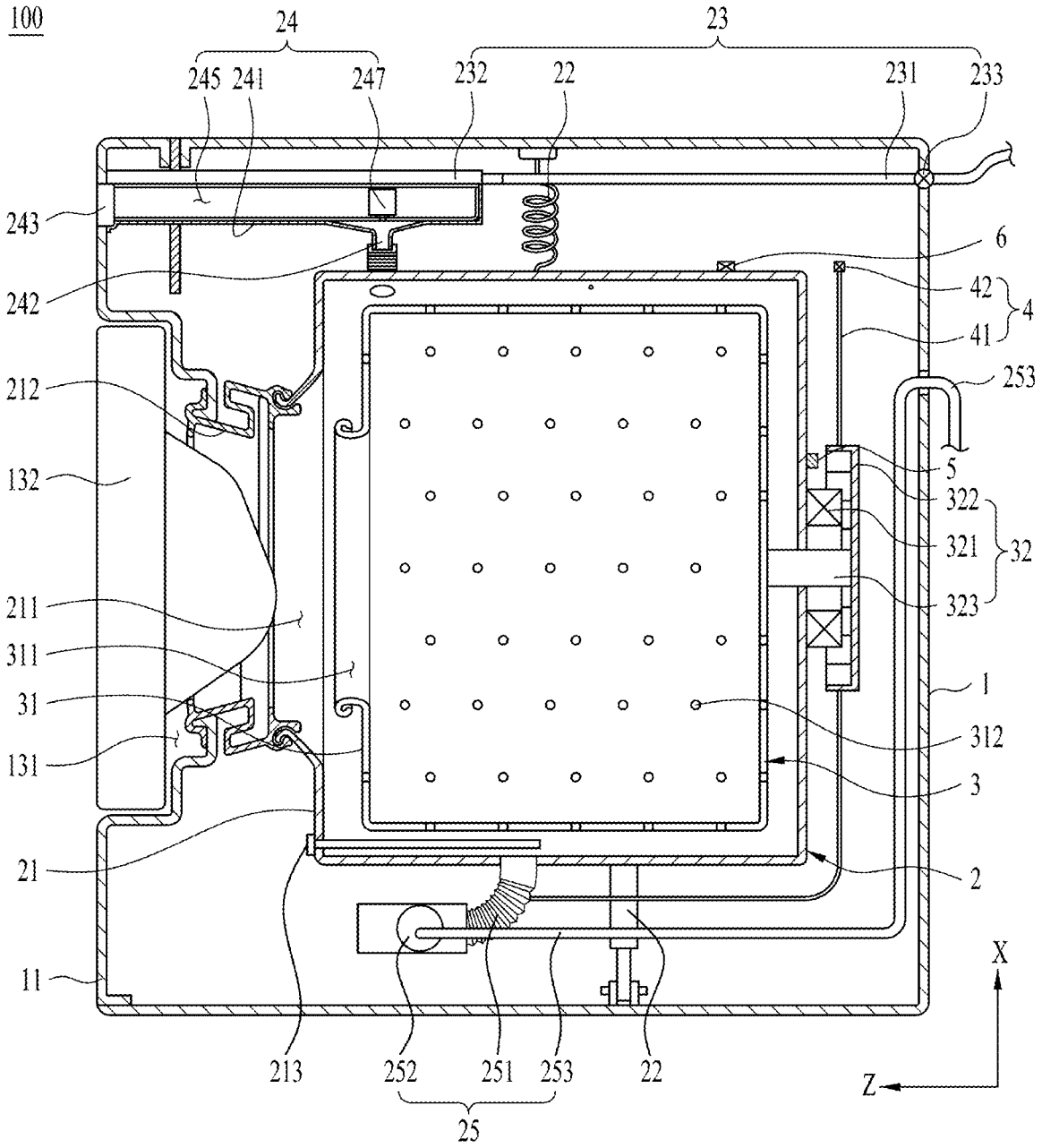

【FIG. 3】
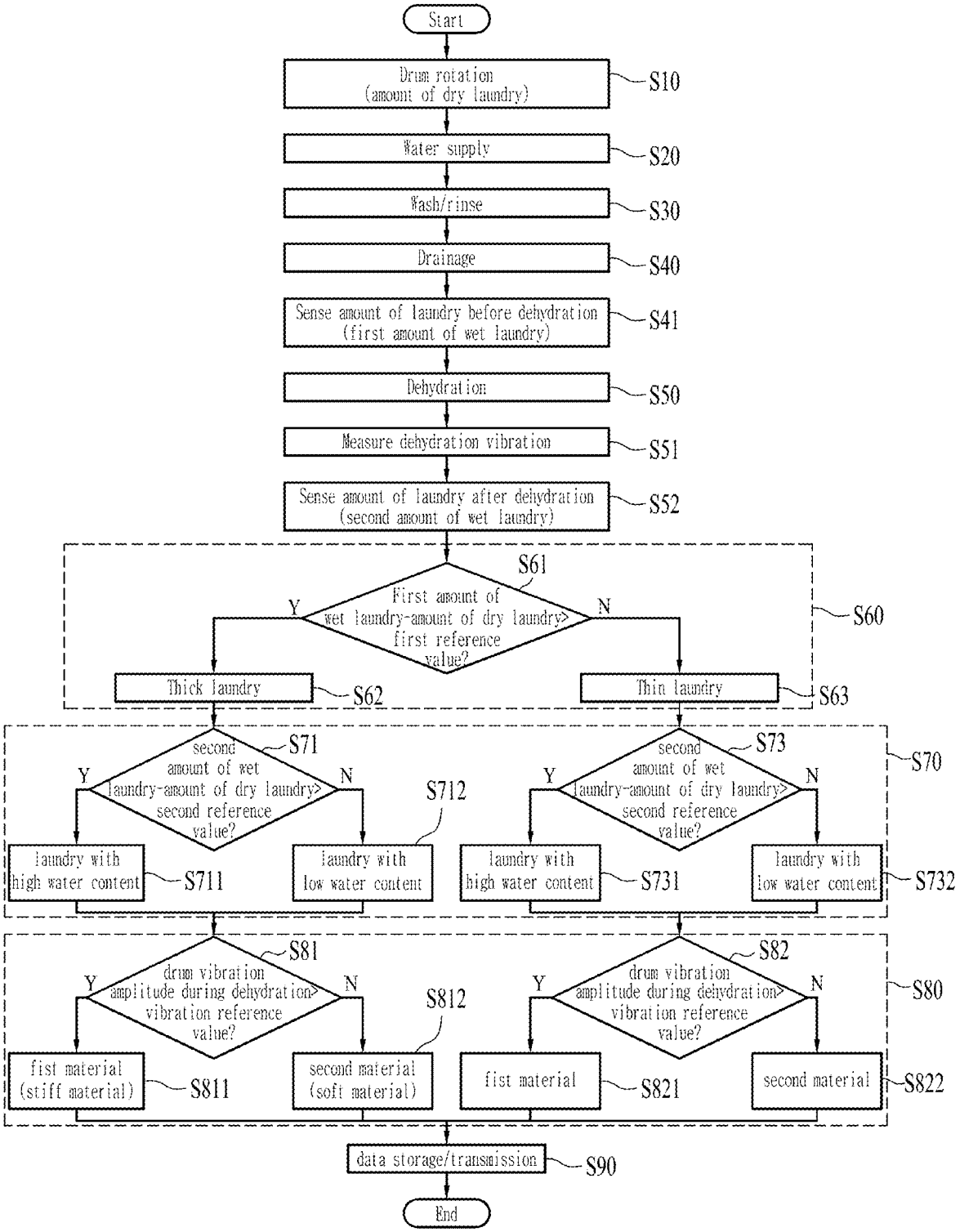

【FIG. 4】
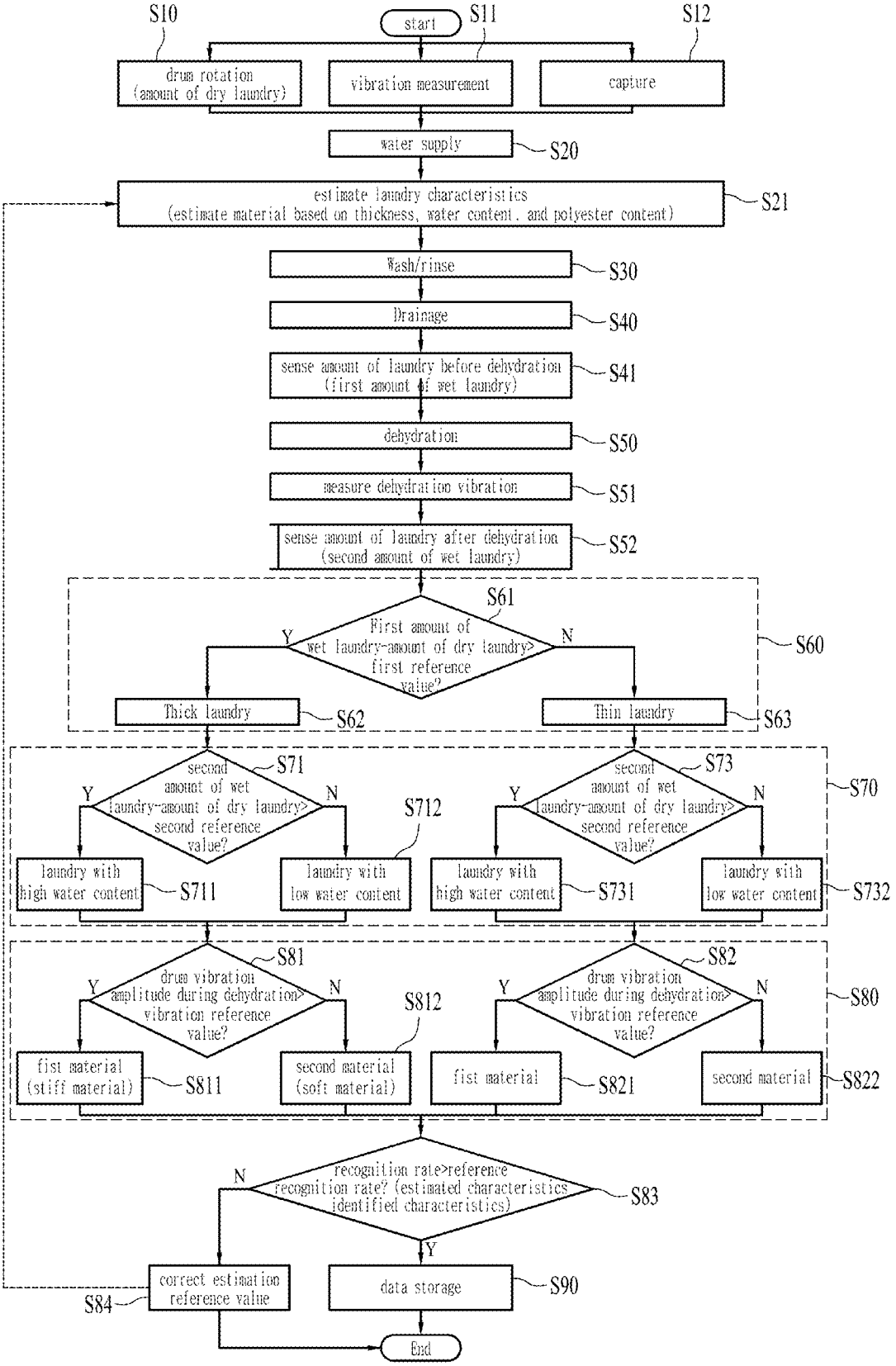

METHOD FOR CONTROLLING CLOTHING TREATMENT APPARATUS

CROSS REFERENCE TO RELATED APPLICATIONS

This application is the National Phase of PCT International Application No. PCT/KR2022/018293, filed on Nov. 18, 2022, which claims priority under 35 U.S.C. 119 (a) to Patent Application No. 10-2021-0174723, filed in the Republic of Korea on Dec. 8, 2021, all of which are hereby expressly incorporated by reference into the present application.

TECHNICAL FIELD

The present disclosure relates to a method for controlling a laundry treating apparatus.

BACKGROUND

A laundry treating apparatus is a general term for apparatuses including a washing machine that washes laundry or the like, and a dryer that dries the laundry or the like.

An existing laundry treating apparatus includes a tub in which water is stored, a drum rotatably disposed inside the tub to provide a space where an object-to-be-treated (an object-to-be-washed and an object-to-be-dried) is accommodated, and a motor that provides power necessary for rotation of the drum.

Among the existing laundry treating apparatuses, there is one that distinguishes a type of the object-to-be-treated put into the drum and adjusts an amount of water supplied to the tub or the number of rotations of the drum based on the type of the object-to-be-treated.

A method for controlling the existing laundry treating apparatus described above includes a water supply step of supplying water to the tub, a step of rotating the drum after the water supply step, a step of measuring an amount of current supplied to the motor during the rotation of the drum, and a step of distinguishing the type of laundry based on the measured amount of current (Patent Publication No. 10-2001-0105608).

In the control method of distinguishing the type of laundry through the above-described process, water is supplied to the tub and then the drum is rotated, so that the amount of current supplied to the motor for the rotation of the drum varies based on a degree to which the laundry absorbs water. Therefore, the control method for distinguishing the type of laundry of the existing laundry treating apparatus is merely a method of categorizing the laundry into laundry with a high water absorption rate and laundry with a low water absorption rate, and has difficulty in determining whether the laundry is made of a soft material or is made of a stiff material.

SUMMARY

Technical Problem

The present disclosure is to provide a laundry treating apparatus with an algorithm to distinguish a material of laundry based on a thickness, a moisture content, and a polyester content, and a method for controlling the same.

In addition, the present disclosure is to provide a method for controlling a laundry treating apparatus that differently controls a treating process of laundry depending on a material of the laundry, which is distinguished based on a thickness, a moisture content, and a polyester content.

Technical Solutions

Provided is a method for controlling a laundry treating apparatus including a tub where water is stored, a drum rotatably disposed inside the tub to provide a space where laundry is accommodated, a water supply that supplies water to the tub, and a drainage that discharges water from the tub including a first sensing step of sensing an amount of laundry by rotating the drum, a water supply step of supplying water to the tub up to a preset reference water level for each amount of laundry, a foreign substance removing step of rubbing the laundry with water by rotating the drum, a drainage step of draining water stored in the tub, a second sensing step of sensing an amount of laundry stored in the drum after the drainage step, a dehydration step of removing water from the laundry by rotating the drum, a third sensing step of sensing an amount of laundry stored in the drum after the dehydration step, a first determination step of determining a material of the laundry based on a thickness via a difference between the amount of laundry measured in the second sensing step and the amount of laundry measured in the first sensing step, and a second determination step of determining a material of the laundry based on a moisture content via a difference between the amount of laundry measured in the third sensing step and the amount of laundry measured in the first sensing step.

In one implementation, the first determination step may include determining that the laundry is made of a thick material when the difference between the amount of laundry measured in the second sensing step and the amount of laundry measured in the first sensing step is greater than a preset first reference value.

In one implementation, the first determination step may include determining that the laundry is made of a thin material when the difference between the amount of laundry measured in the second sensing step and the amount of laundry measured in the first sensing step is smaller than the first reference value.

In one implementation, the second determination step may include determining that the laundry is made of a material with a high moisture content when the difference between the amount of laundry measured in the third sensing step and the amount of laundry measured in the first sensing step is greater than a preset second reference value.

In one implementation, the second determination step may include determining that the laundry is made of a material with a low moisture content when the difference between the amount of laundry measured in the third sensing step and the amount of laundry measured in the first sensing step is smaller than the second reference value.

In one implementation, the method may further include a dehydration vibration measurement step of measuring vibration of the drum while the dehydration step is in progress, and a third determination step of determining that laundry made of a material with a polyester content lower than 50% is included when a vibration amplitude of the drum measured in the dehydration vibration measurement step is greater than a preset vibration reference value.

In one implementation, the third determination step may include determining that laundry made of a material with a polyester content equal to or higher than 50% is included when the vibration amplitude of the drum measured in the dehydration vibration measurement step is smaller than the vibration reference value.

In one implementation, the method may further include a storage step of storing information on the thickness and the material identified via the first determination step, the second determination step, and the third determination step to be matched with data measured in the first sensing step, the second sensing step, the third sensing step, and the dehydration vibration measurement step.

In one implementation, the method may further include a vibration measurement step of measuring the vibration of the drum while the first sensing step is in progress, and an estimation step of estimating a material of the laundry based on the thickness and the moisture content of the laundry, and a material based on the polyester content via the vibration amplitude of the drum measured in the vibration measurement step and an amount of water supplied via the water supply step.

In one implementation, the estimation step may include estimating the material of the laundry based on the thickness and the moisture content of the laundry by comparing a difference between a set water supply amount set for the amount of laundry identified in the first sensing step and the amount of water supplied via the water supply step with a preset first estimation reference value, and estimating the material of the laundry based on the polyester content by comparing the vibration amplitude measured in the vibration measurement step with a preset second estimation reference value.

In one implementation, the method may include a capturing step of taking a photo or a video of the laundry inside the drum before starting the water supply step, and a step of estimating the material of the laundry based on the polyester content via information captured via the capturing step.

In one implementation, the method may further include a recognition rate identifying step of comparing the material of the laundry estimated in the estimation step with the material identified in each of the first determination step, the second determination step, and the third determination step.

In one implementation, the method may further include a correction step of changing the first estimation reference value and the second estimation reference value when a coincidence rate between the material estimated in the estimation step and the material identified in each determination step is lower than a preset reference recognition rate.

In one implementation, the foreign substance removing step may include determining at least one of a number of rotations of the drum, a rotation direction change period of the drum, and a temperature of water for executing the foreign substance removing step, based on the material estimated in the estimation step.

Advantageous Effects

The present disclosure provides the laundry treating apparatus with the algorithm to distinguish the material of the laundry based on the thickness, the moisture content, and the polyester content (for determining whether the laundry is made of the soft material or whether the laundry is made of the stiff material), and the method for controlling the same.

In addition, the present disclosure provides the method for controlling the laundry treating apparatus that differently controls the treating process of the laundry depending on the material of the laundry, which is distinguished based on the thickness, the moisture content, and the polyester content.

BRIEF DESCRIPTION OF THE DRAWINGS

FIGS. 1 and 2 show an example of a laundry treating apparatus.

FIGS. 3 and 4 show respective examples of a method for controlling a laundry treating apparatus.

BEST MODE

Hereinafter, a preferred embodiment of a laundry treating apparatus and a method for controlling a laundry treating apparatus will be described in detail with reference to the attached drawings.

As shown in FIGS. 1 and 2, a laundry treating apparatus 100 includes a cabinet 1, a tub 2 disposed inside the cabinet to store water therein, and a drum 3 disposed inside the tub to provide a space where laundry is stored.

As shown in FIG. 2, the cabinet 1 includes a front panel 11 that forms a front surface of the laundry treating apparatus, and the front panel 11 includes an inlet 12 that allows the inside and the outside of the cabinet 1 to be in communication with each other. The inlet 12 is closed by a door 13 pivotably fixed to the cabinet 1.

As shown in FIG. 1, the front panel 11 may have a control panel 15. The control panel 15 may include an input unit that receives a control command from a user and a display that provides information to the user.

As shown in FIG. 2, the tub 2 may be formed as a hollow tub body 21 in a cylindrical shape. The tub body 21 may be fixed inside the cabinet 1 via a tub support 22. FIG. 2 shows a case in which the tub support 22 is composed of a spring (connecting an upper space of the tub body to the cabinet) and a damper (connecting a lower space of the tub body to the cabinet) as an example.

In a space provided by the tub body 21, a tub inlet 211 is defined in a surface facing the inlet 12. The inlet 12 of the cabinet and the tub inlet 211 are connected to each other via a gasket 212.

The tub body 21 may have a heater 213 that heats water stored in the tub. The heater 213 may be fixed to the tub body 21 to be located at a vertical level lower than that of the tub inlet 211.

The tub body 21 may receive water via a water supply 23, and water stored in the tub body 21 may be discharged to the outside of the cabinet 1 via a drainage 25.

The drainage 25 may include a pump 252 located at a vertical level lower than that of a bottom surface of the tub body 21, a first drain pipe 251 that connects the tub body 21 with the pump 252, and a second drain pipe 253 that guides water discharged from the pump 525 to the outside of the cabinet.

The water supply 23 may be composed of a water supply pipe 231 that connects a water supply source located outside the cabinet with the tub body 21, and a water supply valve 233 that controls opening and closing of the water supply pipe 231.

As shown in the drawing, the laundry treating apparatus 100 may further include a detergent supply 24.

The detergent supply 24 may include a drawer housing 241 disposed inside the cabinet 1, a supply pipe 242 that connects the drawer housing to the tub body 21, and a drawer 243 that is extendable from the drawer housing 241 via a drawer inlet defined in the front panel 11.

The drawer 243 may include a chamber 245 that provides a space for storing detergent, and a discharge flow channel 247 that discharges the detergent inside the chamber to the drawer housing 241. The discharge flow channel 247 may be formed as a water trap (a siphon passage and the like) that, when a level of liquid stored in the chamber 245 exceeds a preset level, allows the liquid to flow to the drawer housing 241.

When the detergent supply 24 is disposed in the laundry treating apparatus 100, the water supply 23 may be further equipped with a nozzle 232 to supply water to the chamber 245. The nozzle 232 may be fixed to the cabinet 1 to form a top surface of the drawer housing 241, and the water supply pipe 231 may connect the nozzle 232 with the water supply source.

The drum 3 may include a cylindrical drum body 31 located inside the tub body 21, and a driver 32 that rotatably fixes the drum body 31 to the tub body 21.

In a space provided by the drum body 31, a drum inlet 311 is defined in a surface facing the tub inlet 211. Accordingly, the laundry may be input into the drum body 31 via the inlet 12, the tub inlet 211, and the drum inlet 311.

The drum body 31 includes drum through-holes 312 that allow the inside and the outside of the drum body to be in communication with each other. The drum through-holes 312 may be defined in each of a circumferential surface, a front surface (a surface surrounding the drum inlet), and a rear surface of the drum body 31. Accordingly, water or the detergent supplied into the tub body 21 may be supplied into the drum body 31 via the drum through-holes 312.

The driver 32 may include a stator 321 that is fixed to a rear surface of the tub body 21 to form a rotating magnetic field, a rotor 322 that rotates by the rotating magnetic field, and a rotation shaft 323 that extends through the rear surface of the tub body 21 to connect the drum body 31 with the rotor 322. Multiple permanent magnets may be fixed to the rotor 322, and the multiple permanent magnets may be fixed to the rotor 322 such that N and S poles are alternately exposed.

An amount of water stored in the tub body 21 may be measured via a water level sensor 4.

The water level sensor 4 may be equipped as various devices as long as it may sense the amount of water stored in the tub body 21. FIG. 2 shows a case in which the water level sensor 4 is composed of a connection pipe 41 that is in communication with the inside of the tub body 21 via the first drain pipe 251, and a pressure sensor 42 that senses a pressure inside the connection pipe as an example. In this case, a controller of the laundry treating apparatus 100 may determine a water level inside the tub body 21 via a signal provided from the pressure sensor 42.

The laundry treating apparatus 100 controls an amount of water supplied to the tub body 21 differently depending on an amount of laundry put into the drum body 31.

For example, when a first amount of laundry is stored in the drum body 31, the controller (not shown) may supply water to the tub body 21 until a water level set for the first amount is reached. Additionally, when a second amount of laundry is stored in the drum body 31, the controller may supply water to the tub body 21 until a water level set for the second amount is reached.

A reference water level set based on an amount of laundry checked before supplying water (a reference water level for each amount of laundry) is a value set in advance via an experiment and an amount of water absorbed by the laundry is variable depending on a material of the laundry, so that, even when the amount of laundry checked before supplying water is the same, an amount of water supplied to the tub body 21 may vary until the reference water level for each amount of laundry is reached.

The laundry treating apparatus 100 may have a rotation sensor 5 that senses a rotation angle, a rotation speed, and the like of the drum body 31.

The rotation sensor 5 may be equipped as various devices as long as it may realize the above-described function. FIG. 2 shows a case in which the rotation sensor 5 is formed as a Hall sensor that may sense a magnitude of a magnetic force of the permanent magnet fixed to the rotor 322, a change in a magnetic pole (a change period of the N pole and the S pole), and the like as an example.

When the rotation sensor 5 is formed as the Hall sensor, the laundry treating apparatus 100 may estimate whether the drum body 31 is vibrating and a magnitude of the vibration by calculating a rotation speed deviation of the drum body.

Additionally, the rotation sensor 5 may be used to sense the amount of laundry stored in the drum body 31. As the amount of laundry input to the drum body 31 increases, a load on the driver 32 increases. Therefore, when comparing an amount of power supplied to the stator 321 to rotate the drum body 31 to a preset rotation angle or to accelerate the drum body 31 to a preset rotation speed with an amount of power categorized based on the amount of laundry, the amount of laundry input to the drum body may be estimated.

The tub body 21 may further include a vibration sensor 6 that senses vibration of the tub body. The laundry treating apparatus 100 equipped with the vibration sensor 6 may determine whether the drum body 31 is vibrating and the magnitude of the vibration by measuring the vibration of the tub body 21.

FIG. 3 shows an example of a method for controlling a laundry treating apparatus having the above-described structure.

The control method in FIG. 3 includes a first sensing step (S10) of sensing the amount of laundry by rotating the drum body 31, a water supply step (S20) of supplying a preset amount of water into the tub based on the amount of laundry checked in the first sensing step, a foreign substance removing step (S30) of rotating the drum body 31 to rub water with the laundry, and a drainage step (S40) of draining water stored in the tub body 21.

The first sensing step (S10), as a process of determining the amount of laundry that is not wet with water (an amount of dry laundry), may be performed in various ways. That is, the first sensing step (S10) may sense the amount of dry laundry by sensing sagging of the tub body 21, or may sense the amount of dry laundry via data measured by the rotation sensor 5.

The process of sensing the amount of dry laundry via the rotation sensor 5 may be as follows. That is, the first sensing step (S10) may include rotating the drum body 31 at a preset angle or accelerating the drum body 31 to a preset number of rotations, measuring the power supplied to the stator 321 while the drum rotates, and estimating the amount of laundry by comparing the measured power with an experimental value measured based on the amount of dry laundry.

The water supply step (S20) is a process in which the controller controls the water supply valve 233 to supply water to the tub body 21. The laundry treating apparatus 100 stores the reference water level for each amount of laundry set to increase in proportion to the amount of dry laundry. The water supply step (S20) may supply water until the water level of the tub body 21 reaches a reference water level set for the amount of dry laundry measured in the first sensing step (S10).

The foreign substance removing step (S30) is a process of removing dirt in the laundry by rotating the drum body 31 to cause friction between the laundry and water and friction between the laundry and the drum body 31.

The foreign substance removing step (S30) may include at least one of rotating the drum body 31 clockwise, rotating the drum body 31 counterclockwise, and alternately executing the clockwise rotation and the counterclockwise rotation of the drum body.

In addition, the foreign substance removing step (S30) may include heating water stored in the tub body 21 by operating the heater 213. In this case, the steps of rotating the drum body 31 described above may be started when a temperature of the water reaches a preset temperature, or may be started simultaneously with the operation of the heater.

The drainage step (S40) may be a process of discharging water inside the tub body 21 to the outside of the cabinet 1 by operating the pump 252.

When the drainage step (S40) is completed, the control method proceeds with a second sensing step (S41) of sensing the amount of laundry stored in the drum. The second sensing step (S41), as a process of sensing an amount of laundry wet with water (a first amount of wet laundry (an amount of wet laundry before dehydration)), may proceed with the same process as the first sensing step (S10).

That is, the second sensing step (S41) may include rotating the drum body 31 at a preset angle or accelerating the drum body 31 to a preset number of rotations, measuring the power supplied to the stator 321 while the drum rotates, and estimating the amount of laundry by comparing the measured power with an experimental value measured based on the amount of wet laundry before the dehydration.

Upon completion of the second sensing step (S41), the control method proceeds to a dehydration step (S50) of rotating the drum body 31 to remove water from the laundry.

Upon completion of the dehydration step, the control method proceeds with a third sensing step (S52) of sensing an amount of laundry stored in the drum.

The third sensing step (S52), as a process of sensing an amount of laundry that has been dehydrated (a second amount of wet laundry (an amount of wet laundry after the dehydration)), may proceed with the same process as the second sensing step (S41). That is, the third sensing step (S52) may include rotating the drum body 31 at a preset angle or accelerating the drum body 31 to a preset number of rotations, measuring the power supplied to the stator 321 while the drum rotates, and estimating the amount of laundry by comparing the measured power with an experimental value measured based on the amount of wet laundry after the dehydration.

Upon completion of the third sensing step (S52), the control method may proceed with a first determination step (S60) of determining a material of the laundry based on a thickness, and a second determination step (S70) of determining a material of the laundry based on a moisture content.

The first determination step (S60) may include comparing (S61) a difference between the first amount of wet laundry measured in the second sensing step (S41) and the amount of dry laundry measured in the first sensing step (S10) with a preset first reference value.

In other words, when a value obtained by subtracting the amount of dry laundry from the first amount of wet laundry is greater than the first reference value, the first determination step (S60) may proceed with determining (S62) that the laundry is made of a thick material (S62), and when the value obtained by subtracting the amount of dry laundry from the first amount of wet laundry is smaller than the first reference value, the first determination step (S60) may proceed with determining (S63) that the laundry is made of a thin material.

According to an experiment, the thicker the laundry, the greater the difference between the first amount of wet laundry and the amount of dry laundry. Therefore, the control method including the above-described first determination step (S60) may determine the thickness of the laundry.

The second determination step (S70) may include comparing (S71 and S73) a difference between the second amount of wet laundry measured in the third sensing step and the amount of dry laundry measured in the first sensing step with a preset second reference value.

In other words, when a value obtained by subtracting the amount of dry laundry from the second amount of wet laundry is greater than the second reference value, the second determination step (S70) may proceed with determining (S711 and S731) that the laundry is made of a material with a high moisture content, and when the value obtained by subtracting the amount of dry laundry from the second amount of wet laundry is smaller than the second reference value, the second determination step (S70) may proceed with determining (S712 and S732) that the laundry is made of a material with a low moisture content.

The higher the moisture content of the laundry, the greater the difference between the second amount of wet laundry and the amount of dry laundry. Therefore, the control method including the above-described second determination step (S70) may determine the material of the laundry based on the moisture content.

Furthermore, the control method may further include a third determination step (S80) of distinguishing the material of the laundry based on a polyester content. The third determination step (S80) may include determining the material of the laundry by comparing the vibration of the drum body 31 measured during the dehydration step (S50) with a preset vibration reference value.

To execute the third determination step (S80), the control method may further include a dehydration vibration measurement step (S51) of measuring vibration of the drum body 31 during the dehydration step (S50).

The dehydration vibration measuring step (S51) may be a step of estimating, by the controller, the vibration of the drum body 31 via data provided to at least one of the vibration sensor 6 and the rotation sensor 5.

The third judgment step (S80) may include steps (S81 and S82) of comparing a vibration amplitude (a range of the vibration) of the drum body 31 measured in the dehydration vibration measurement step (S51) with a preset vibration reference value.

Because laundry made of a soft material (laundry made of a material with a polyester content equal to or higher than 50% (a second material)) is relatively light, the amplitude of the vibration occurred in the drum body 31 during the dehydration step (S50) tends to be small. Further, because laundry made of a stiff material (laundry made of a material with a polyester content lower than 50% (a first material)) is relatively heavy, the amplitude of the vibration occurred in the drum body 31 during the dehydration step (S50) tends to be great.

Therefore, when the measured vibration amplitude of the drum is smaller than the vibration reference value (S81 and S82), the control method may proceed with determining (S812 and S822) that the material of the laundry is the soft material (determining as the second material). Further, when the measured vibration amplitude of the drum is greater than the vibration reference value (S81 and S82), the control method may proceed with determining (S811 and S821) that the material of the laundry is the stiff material (determining as the first material).

Upon completion of the third determination step (S80), the control method may proceed with a storage step (S90). The storage step (S90) may be a process of storing information on the material (information on the material distinguished based on the thickness, the moisture content, and the polyester content) identified via the first determination step (S60), the second determination step (S70), and the third determination step (S80) to be matched with the data measured in the first sensing step (S10), the second sensing step (S41), the third sensing step (S52), and the dehydration vibration measurement step (S51). Accordingly, the laundry treating apparatus 100 may recognize the laundry materials by classifying them into eight types via information identified during operation of the laundry treating apparatus.

The information stored via the storage step (S90) may be used as learning data for an artificial intelligence algorithm installed within the laundry treating apparatus or on an external server connected to the laundry treating apparatus via a network.

FIG. 4 shows another embodiment of a control method.

One of differences from the embodiment in FIG. 3 is that the control method in the present embodiment includes a vibration measurement step (S12) and an estimation step (S21).

The vibration measurement step (S12) may be a step of measuring the vibration of the drum body 31 when the drum body 31 rotates for the first sensing step (S10). The vibration measurement step (S12) may be a step of estimating, by the controller, the vibration of the drum body 31 via the data provided by at least one of the vibration sensor 6 and the rotation sensor 5.

The estimation step (S21) is a step of estimating the material based on the thickness, the water content, and the polyester content of the laundry via the vibration amplitude of the drum body 31 measured in the vibration measurement step (S11) and the amount of water supplied via the water supply step (S20).

In other words, the estimation step (S21) may include estimating the material of the laundry based on the thickness and the moisture content of the laundry by comparing the amount of water supplied to the tub via the water supply step (S20) (the amount of water supplied until the water level in the tub reaches the reference water level for each amount of laundry) with a set water supply amount set based on the amount of dry laundry identified in the first sensing step (S10).

As the laundry is made of a material with a greater thickness and a higher moisture content, a greater amount of water should be supplied to reach the reference water level for each amount of laundry, so that a difference between the amount of water supplied via the water supply step (S20) and the water supply amount set based on the amount of dry laundry tends to increase. Therefore, the estimation step (S21) may distinguish the material of the laundry based on the thickness and the moisture content.

In addition, the estimation step (S21) may estimate the material of the laundry based on the polyester content by comparing the vibration amplitude measured in the vibration measurement step (S11) with a preset second estimation reference value.

Specifically, the estimation step (S21) may be as follows.

The estimation step (S21) may include estimating the material of the laundry based on the thickness and the moisture content of the laundry by comparing a difference between the set water supply amount set for the amount of dry laundry identified in the first sensing step (S10) and the amount of water supplied via the water supply step (S20) with a preset first estimation reference value, and estimating the material of the laundry based on the polyester content by comparing the vibration amplitude measured in the vibration measurement step (S11) with the preset second estimation reference value.

The process of determining the material of the laundry based on the polyester content (determining whether the laundry is made of the first material or the second material) may proceed by comparing data (photos, videos, or the like) captured via a camera with data for each material prepared via an experiment.

In this case, the control method may further include a capturing step (S12) of capturing the inside of the drum body while the drum body 31 is rotating. The camera executing the capturing step (S12) should be mounted in a space capable of capturing the inside of the drum body 31. The door 13 that opens and closes the inlet 12 may be an example of the mounting location of the camera.

While the estimation step (S21) is in progress or after the estimation step (S21) is completed, the control method according to the present embodiment proceeds with the foreign substance removing step (S30).

The foreign substance removing step (S30) in the present embodiment may determine at least one of the number of rotations of the drum, a rotation direction change period of the drum, and the temperature of water, based on the material of the laundry estimated in the estimation step (S21).

For example, the thicker the laundry, the higher the rotation speed of the drum may be set and the shorter the rotation direction change period of the drum may be set. In addition, the higher the moisture content, the higher the rotation speed in the dehydration step (S50) may be set, and the softer the material, the lower the temperature of water may be set.

Upon completion of the foreign substance removing step (S30), the control method proceeds with the drainage step (S40), the second sensing step (S41), the dehydration step (S50), the dehydration vibration measurement step (S51), the third sensing step (S52), the first determination step (S60), the second determination step (S70), and the third determination step (S80). A specific execution process of each step is the same as described in the embodiment in FIG. 3.

Upon completion of the third determination step (S80), the control method in FIG. 4 proceeds with a recognition rate identifying step (S83). The recognition rate identifying step (S83) may be a step of comparing the material of the laundry estimated in the estimation step (S21) with the material identified in the first determination step (S60), the second determination step (S70), and the third determination step (S80).

When a coincidence rate between the material estimated in the estimation step (S21) and the material identified in each determination step is lower than a preset reference recognition rate (S83), the control method may proceed with a correction step (S84) of changing the first estimation reference value and the second estimation reference value. The correction step (S84) may include correcting the first estimation reference value and the second estimation reference value in a direction of increasing the recognition rate via the artificial intelligence algorithm.

Although not shown in the drawing, when a situation in which the recognition rate is lower than the reference recognition rate occurs a reference number of times or more, the control method may execute a process of changing reference values (the first reference value, the second reference value, and the vibration reference value) for the first determination step (S60), the second determination step (S70), and the third determination step (S80).

Because the structure and the control method of the laundry treating apparatus described above relate to the embodiment, the scope of rights of the present disclosure is not limited to the embodiment described above.

What is claimed is:

1. A method for controlling a laundry treating apparatus including a tub where water is stored, a drum rotatably disposed inside the tub to provide a space where laundry is accommodated, a water supply configured to supply water to the tub, and a drainage configured to discharge water from the tub, the method comprising:

a first sensing step of sensing an amount of laundry by rotating the drum;

a water supply step of supplying water to the tub up to a preset reference water level for each amount of laundry;

a foreign substance removing step of rubbing the laundry with water by rotating the drum;

a drainage step of draining water stored in the tub;

a second sensing step of sensing an amount of laundry stored in the drum after the drainage step;

a dehydration step of removing water from the laundry by rotating the drum;

a third sensing step of sensing an amount of laundry stored in the drum after the dehydration step;

a first determination step of determining a material of the laundry based on a thickness via a difference between the amount of laundry measured in the second sensing step and the amount of laundry measured in the first sensing step; and a second determination step of determining a material of the laundry based on a moisture content via a difference between the amount of laundry measured in the third sensing step and the amount of laundry measured in the first sensing step.

2. The method of claim 1, wherein the first determination step includes determining that the laundry is made of a thick material when the difference between the amount of laundry measured in the second sensing step and the amount of laundry measured in the first sensing step is greater than a preset first reference value.

3. The method of claim 2, wherein the first determination step includes determining that the laundry is made of a thin material when the difference between the amount of laundry measured in the second sensing step and the amount of laundry measured in the first sensing step is smaller than the first reference value.

4. The method of claim 2, wherein the second determination step includes determining that the laundry is made of a material with a high moisture content when the difference between the amount of laundry measured in the third sensing step and the amount of laundry measured in the first sensing step is greater than a preset second reference value.

5. The method of claim 4, wherein the second determination step includes determining that the laundry is made of a material with a low moisture content when the difference between the amount of laundry measured in the third sensing step and the amount of laundry measured in the first sensing step is smaller than the second reference value.

6. The method of claim 5, further comprising:

a dehydration vibration measurement step of measuring vibration of the drum while the dehydration step is in progress; and a third determination step of determining that laundry made of a material with a polyester content lower than 50% is included when a vibration amplitude of the drum measured in the dehydration vibration measurement step is greater than a preset vibration reference value.

7. The method of claim 6, wherein the third determination step includes determining that laundry made of a material with a polyester content equal to or higher than 50% is included when the vibration amplitude of the drum measured in the dehydration vibration measurement step is smaller than the vibration reference value.

8. The method of claim 7, further comprising:

a storage step of storing information on the thickness and the material identified via the first determination step, the second determination step, and the third determination step to be matched with data measured in the first sensing step, the second sensing step, the third sensing step, and the dehydration vibration measurement step.

9. The method of claim 8, further comprising:

a vibration measurement step of measuring the vibration of the drum while the first sensing step is in progress; and an estimation step of estimating a material of the laundry based on the thickness and the moisture content of the laundry, and a material based on the polyester content via the vibration amplitude of the drum measured in the vibration measurement step and an amount of water supplied via the water supply step.

10. The method of claim 9, wherein the estimation step includes:

estimating the material of the laundry based on the thickness and the moisture content of the laundry by comparing a difference between a set water supply amount set for the amount of laundry identified in the first sensing step and the amount of water supplied via the water supply step with a preset first estimation reference value; and estimating the material of the laundry based on the polyester content by comparing the vibration amplitude measured in the vibration measurement step with a preset second estimation reference value.

11. The method of claim 10, further comprising:

a recognition rate identifying step of comparing the material of the laundry estimated in the estimation step with the material identified in each of the first determination step, the second determination step, and the third determination step.

12. The method of claim 11, further comprising:

a correction step of changing the first estimation reference value and the second estimation reference value when a coincidence rate between the material estimated in the estimation step and the material identified in each determination step is lower than a preset reference recognition rate.

13. The method of claim 10, wherein the foreign substance removing step includes determining at least one of a number of rotations of the drum, a rotation direction change period of the drum, and a temperature of water for executing the foreign substance removing step, based on the material estimated in the estimation step.

* * * * *